US008024871B2

(12) United States Patent
Han et al.

(10) Patent No.: US 8,024,871 B2
(45) Date of Patent: Sep. 27, 2011

(54) EXHAUST STRUCTURE FOR CLOTHES DRYER IN APARTMENT BUILDING

(75) Inventors: In Hee Han, Changwon-si (KR); Won Tug Son, Seoul (KR)

(73) Assignee: LG Electronics Inc., Seoul (KR)

( * ) Notice: Subject to any disclaimer, the term of this patent is extended or adjusted under 35 U.S.C. 154(b) by 993 days.

(21) Appl. No.: 11/979,741

(22) Filed: Nov. 7, 2007

(65) Prior Publication Data

US 2008/0127505 A1 Jun. 5, 2008

(30) Foreign Application Priority Data

Nov. 8, 2006 (KR) ..... 10-2006-0110148
Nov. 8, 2006 (KR) ..... 10-2006-0110149

(51) Int. Cl.
*F26B 25/00* (2006.01)

(52) U.S. Cl. ..... 34/602; 34/606; 34/610; 454/350; 454/359; 68/19; 68/20

(58) Field of Classification Search ..... 34/595, 34/601, 602, 603, 606, 610, 235.82; 454/350, 454/354, 3, 59; 68/19, 20
See application file for complete search history.

(56) References Cited

U.S. PATENT DOCUMENTS 1,990,324 A * 2/1935 Herdlein ..... 165/229
2,053,393 A * 9/1936 Clarkson ..... 454/108
2,078,540 A * 4/1937 Miller ..... 165/50
2,137,996 A * 11/1938 Crawford ..... 165/223
2,142,042 A * 12/1938 Bowdoin et al. ..... 34/486
2,146,542 A * 2/1939 Hawley ..... 110/221
RE21,203 E * 9/1939 Thatcher ..... 165/50
2,707,837 A * 5/1955 Paulsen et al. ..... 34/607
2,802,462 A * 8/1957 Williams ..... 600/21
2,852,241 A * 9/1958 Jackson ..... 432/46
2,864,175 A * 12/1958 Stone ..... 34/75
3,012,333 A * 12/1961 Leonard ..... 34/75
3,161,481 A * 12/1964 Edwards ..... 34/527
3,227,061 A * 1/1966 Swayze ..... 454/200
3,238,636 A * 3/1966 Chafee, Jr. et al. ..... 34/527
3,273,256 A * 9/1966 Behrens ..... 34/546
3,415,178 A 12/1968 Ball et al.
3,673,701 A * 7/1972 Albertson ..... 34/90
3,849,063 A * 11/1974 Eichenlaub ..... 432/185
3,940,861 A * 3/1976 Frazar ..... 34/75
3,941,556 A * 3/1976 Pallagi ..... 431/202
4,122,612 A * 10/1978 Mrofchak ..... 34/86
4,137,647 A * 2/1979 Clark, Jr. ..... 34/82
4,231,769 A * 11/1980 Ahlrich ..... 96/229
4,268,247 A * 5/1981 Freze ..... 432/21
(Continued)

FOREIGN PATENT DOCUMENTS

CN 101220980 7/2008
(Continued)

*Primary Examiner* — Stephen M. Gravini
(74) *Attorney, Agent, or Firm* — McKenna Long & Aldridge LLP

(57) ABSTRACT

The present invention relates to an exhaust structure for a clothes dryer in an apartment building. The exhaust structure includes at least one riser pipe mounted in a vertical direction crossing every floor of a building to discharge exhaust gas, a plurality of branch pipes branched from the riser pipe to a household in the every floor to guide exhaust gas from the household to the riser pipe, and a fan mounted above a top of the riser pipe and operating in proportion to the amount of exhaust gas in the riser pipe.

17 Claims, 4 Drawing Sheets

U.S. PATENT DOCUMENTS 4,365,582 A * 12/1982 Boyer et al. ..... 116/70
4,367,565 A * 1/1983 Parise ..... 15/321
4,437,608 A 3/1984 Smith
4,541,410 A * 9/1985 Jatana ..... 122/18.3
4,549,362 A * 10/1985 Haried ..... 34/395
4,641,631 A * 2/1987 Jatana ..... 126/101
4,689,896 A * 9/1987 Narang ..... 34/82
4,765,231 A * 8/1988 Aniello ..... 454/239
4,891,892 A * 1/1990 Narang ..... 34/86
4,899,551 A * 2/1990 Weintraub ..... 62/176.6
5,033,489 A * 7/1991 Ferre et al. ..... 134/57 R
5,101,712 A * 4/1992 Dean, Jr. ..... 454/341
5,117,563 A * 6/1992 Castonguay ..... 34/86
5,167,587 A * 12/1992 Mott ..... 474/245
5,333,677 A * 8/1994 Molivadas ..... 165/272
5,426,900 A * 6/1995 Springer ..... 52/79.1
5,467,609 A * 11/1995 Feeney ..... 62/259.2
5,836,545 A * 11/1998 Arlton et al. ..... 244/60
5,860,858 A * 1/1999 Wettergren ..... 454/343
5,874,292 A * 2/1999 McMinn, Jr. ..... 435/262
5,964,985 A * 10/1999 Wootten ..... 201/40
6,013,158 A * 1/2000 Wootten ..... 202/99
6,274,375 B1 * 8/2001 McMinn, Jr. ..... 435/289.1
6,438,865 B1 8/2002 Bradley
6,526,598 B1 * 3/2003 Black ..... 4/214
6,637,127 B2 * 10/2003 Reede et al. ..... 34/527
6,655,047 B2 * 12/2003 Miller, II ..... 34/544
6,671,977 B2 * 1/2004 Beaumont ..... 34/79
6,699,119 B2 3/2004 Boulanger et al.
6,719,625 B2 * 4/2004 Federspiel ..... 454/256
6,745,496 B2 * 6/2004 Cassella ..... 34/621
6,868,621 B1 * 3/2005 Grimm et al. ..... 34/92
7,055,262 B2 * 6/2006 Goldberg et al. ..... 34/86
7,135,332 B2 * 11/2006 Ouellette ..... 435/290.1
7,277,627 B2 * 10/2007 Hughes et al. ..... 392/441
7,389,255 B2 * 6/2008 Formisano ..... 705/7.23
7,665,225 B2 * 2/2010 Goldberg et al. ..... 34/73
7,744,671 B1 * 6/2010 Ouellette ..... 71/9
7,908,766 B2 * 3/2011 Ahn et al. ..... 34/595
2002/0023368 A1 * 2/2002 Beaumont ..... 34/79
2002/0028501 A1 * 3/2002 McMinn, Jr. ..... 435/264
2002/0133969 A1 * 9/2002 Cassella ..... 34/201
2002/0184786 A1 * 12/2002 Miller, II ..... 34/132
2003/0024686 A1 * 2/2003 Ouellette ..... 165/47
2003/0037757 A1 * 2/2003 Osband ..... 123/195 R
2003/0061728 A1 * 4/2003 Reede et al. ..... 34/526
2003/0123863 A1 * 7/2003 Hughes et al. ..... 392/449
2003/0208923 A1 * 11/2003 Lewis ..... 34/471
2004/0045187 A1 * 3/2004 Curry et al. ..... 34/595
2004/0129413 A1 * 7/2004 Yoho, Sr. ..... 165/218
2004/0187343 A1 * 9/2004 Beaumont ..... 34/544
2005/0066538 A1 * 3/2005 Goldberg et al. ..... 34/218
2005/0108982 A1 * 5/2005 Formisano ..... 52/741.1
2005/0167080 A1 * 8/2005 Yoho, Sr. ..... 165/48.1
2006/0041448 A1 * 2/2006 Patterson et al. ..... 705/1
2006/0179676 A1 * 8/2006 Goldberg et al. ..... 34/77
2007/0094946 A1 * 5/2007 Schoeny et al. ..... 52/79.1
2007/0101603 A1 * 5/2007 Beaumont ..... 34/85
2007/0101605 A1 * 5/2007 Susalla ..... 34/202
2007/0251117 A1 * 11/2007 Blount ..... 34/360
2007/0281639 A1 * 12/2007 Clidaras et al. ..... 455/128
2008/0005926 A1 * 1/2008 Goggin ..... 34/605
2008/0034607 A1 * 2/2008 Ahn et al. ..... 34/130
2008/0034608 A1 * 2/2008 Ahn et al. ..... 34/134
2008/0047159 A1 * 2/2008 Mackay ..... 34/82
2008/0055848 A1 * 3/2008 Hamburgen et al. ..... 361/691
2008/0055850 A1 * 3/2008 Carlson et al. ..... 361/695
2008/0127505 A1 * 6/2008 Han et al. ..... 34/72
2008/0127506 A1 * 6/2008 Han et al. ..... 34/235
2008/0141921 A1 * 6/2008 Hinderks ..... 114/274
2008/0204999 A1 * 8/2008 Clidaras et al. ..... 361/696
2009/0038328 A1 * 2/2009 Piccione ..... 62/291
2009/0100702 A1 * 4/2009 Fair ..... 34/487
2009/0100703 A1 * 4/2009 Blount ..... 34/549
2009/0103984 A1 * 4/2009 Zarisfi ..... 405/168.1
2009/0205220 A1 * 8/2009 Dewald et al. ..... 34/513
2009/0235549 A1 * 9/2009 Cartwright ..... 34/92
2009/0272043 A1 * 11/2009 Zwern ..... 52/27
2009/0293384 A1 * 12/2009 Miller ..... 52/185
2010/0000118 A1 * 1/2010 Cunningham ..... 34/487
2010/0011615 A1 * 1/2010 Steiner ..... 34/493
2010/0139113 A1 * 6/2010 Mackay ..... 34/82
2010/0146809 A1 * 6/2010 Grunert et al. ..... 34/443
2010/0146812 A1 * 6/2010 Ahn et al. ..... 34/480
2010/0175898 A1 * 7/2010 Steinicke ..... 169/46
2010/0199515 A1 * 8/2010 Steffens ..... 34/468
2010/0263225 A1 * 10/2010 Balerdi Azpilicueta et al. ..... 34/134
2010/0293804 A1 * 11/2010 Nawrot et al. ..... 34/86

FOREIGN PATENT DOCUMENTS

DE 199 63 837 7/2001
EP 1921200 A2 * 5/2008
EP 1921201 A2 * 5/2008
GB 418 748 10/1934
GB 1 218 736 1/1971
JP 55-153245 11/1980
JP 57-023179 5/1982
JP 01-215361 8/1989
JP 05168797 A * 7/1993
JP 06-205900 7/1994
JP 07100295 A * 4/1995
JP 07-332718 12/1995
JP 11-083106 3/1999
JP 2000-144956 5/2000
JP 2000-161732 6/2000
JP 2000237500 A * 9/2000
JP 2000-274790 10/2000
JP 2002233696 A * 8/2002
JP 2003-056879 2/2003
JP 2003-130414 5/2003
JP 2004-251503 9/2004
JP 2004-290882 10/2004
JP 2008121414 A * 5/2008
JP 2008121415 A * 5/2008
JP 2008122069 A * 5/2008
KR 10-2003-0008647 1/2003
KR 20-0372149 1/2005
KR 20-0396645 9/2005
KR 10-2005-0119258 12/2005
KR 10-2006-0014834 2/2006
WO WO 2005040483 A1 * 5/2005

* cited by examiner

EXHAUST STRUCTURE FOR CLOTHES DRYER IN APARTMENT BUILDING

This application claims the benefit of Korean Patent Applications No. 10-2006-0110148, filed on Nov. 8, 2006 and No. 10-2006-0110149, filed on Nov. 8, 2006, which are hereby incorporated by reference in their entireties as if fully set forth herein.

BACKGROUND OF THE INVENTION

1. Field of the Invention

The present invention relates to a structure for discharging gas from clothes dryers in respective households in an apartment building, especially a high-rise apartment building, to outside the building, and a clothes dryer manufactured suitable for such an exhaust structure. More particularly, the present invention relates to an exhaust structure suitable to discharge gas from clothes dryers, taking into account features of the gas from the clothes dryers.

2. Discussion of the Related Art

Currently in large cities, apartment buildings are becoming a general residence type. Conventionally, most apartment buildings have had 15 stories or less. However, apartment buildings over 20 stories, even 30 to 40 stories or higher, are currently constructed.

In a relatively low-rise apartment building, a conventional gas discharge structure has no serious problem. Even if there is a problem, the problem can be solved by opening windows in respective households to let some fresh air in.

However, a high-rise apartment building has a different situation. A wind speed is low at a low story of the building due to friction with the ground surface, various obstacles such as buildings, or the like. On the other hand, a wind speed becomes higher as it goes to a higher story of the building, because an influence by friction with the ground surface or obstacles such as buildings becomes weak.

Moreover, a vortex becomes more intensive as it goes to a higher story of the building. In other words, because there are fewer obstacles around the high story of the building, wind colliding with the high-rise building climbs a wall of the building or goes over a top of the building. When the wind climbs the wall of the building or goes over the building, the wind speed becomes faster, and even a vortex is formed. Because of the above phenomenon of the wind, it is difficult to ventilate a room by opening the window at the high story of the high-rise building.

Accordingly, as a structure for discharging gas from each household in a high-rise apartment building, there are provided a riser pipe mounted in a vertical direction crossing every floor, and one or more branch pipes connecting each household and the riser pipe. The smell of food generated from a kitchen is discharged to the riser pipe via the branch pipe through a vent hole provided in the kitchen, and gas in a bathroom is discharged to the riser pipe via the branch pipe through a vent hole provided at a ceiling of the bathroom. A non-power fan, which rotates by wind, is mounted above a top of the riser pipe. The non-power fan assists the discharge of the gas from the riser pipe to the outside of the building.

However, the strong wind rushing to a discharge opening at the top of the riser pipe in the high-rise apartment building disturbs smooth discharge of the gas through the riser pipe by the non-power fan.

Moreover, because it is difficult to vent a room by opening the window in the high-rise apartment building, there is generally provided a dryer. Of the dryers, a dryer capable of generating hot air by burning fuel produces harmful exhaust gas including carbon monoxide in addition to general exhaust gas. The conventional high-rise apartment building has a problem such that the exhaust gas cannot be discharged.

Further, the conventional exhaust structure is not suitable for the discharging of the exhaust gas from the clothes dryer, having characteristics of including much moisture, many foreign substances, such as lint, and harmful substances, such as carbon monoxide, when generating hot air by burning fuel. Still further, the conventional exhaust structure is not suitable for the clothes dryer, because the clothes dryer is operated for a long time and produces a large amount of exhaust gas.

SUMMARY OF THE INVENTION

Accordingly, the present invention is directed to an exhaust structure for a clothes dryer in an apartment building that substantially obviates one or more problems due to limitations and disadvantages of the related art.

An object of the present invention is to provide an exhaust structure for a clothes dryer in an apartment building, that can exclusively discharge gas from clothes dryers in a high-rise apartment building to an outside of the building.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an exhaust structure for a clothes dryer in an apartment building comprises: at least one riser pipe mounted in a vertical direction crossing every floor of a building to discharge exhaust gas; a plurality of branch pipes branched from the riser pipe to a household in the every floor to guide exhaust gas from the household to the riser pipe; and a fan mounted above a top of the riser pipe, the fan operating in proportion to the amount of exhaust gas in the riser pipe.

The exhaust structure may further comprise a motor to apply a driving force to the fan, a first pressure sensor to sense a pressure in the riser pipe, and a motor controller to control operation of the motor according to a pressure sensed by the first pressure sensor.

Preferably, the motor controller controls operation of the motor according to the amount of exhaust gas in the riser pipe measured based on the pressure sensed by the first pressure sensor.

Each of the plurality of branch pipes may have at least one of a backflow preventive damper to prevent backflow of the exhaust gas and a fire damper therein. Each of the plurality of branch pipes may have at least one of a lint filter to filter lint and a carbon monoxide filter to filter carbon monoxide therein.

The exhaust structure may further comprise a second pressure sensor provided in front of the lint filter to sense a pressure in each of the plurality of branch pipes. The exhaust structure may further comprise a filter controller to determine whether the lint filter is blocked based on the pressure sensed by the second pressure sensor. The filter controller may determine whether the lint filter is blocked by comparing the sensed pressure with a reference pressure. When the lint filter is blocked, the filter controller may inform a user visually and acoustically that the lint filter is blocked.

The exhaust structure may further comprise a drain structure provided under the riser pipe to drain water condensed from the exhaust gas. The exhaust structure may further comprise an outdoor air pipe connected to a lower portion of the riser pipe, which communicates with an exterior.

The plurality of branch pipes may be connected to the riser pipe with a predetermined downward inclination.

At least one of the plurality of branch pipes may be configured as a branch pipe for dryer to guide the exhaust gas from the clothes dryer provided in the household to the riser pipe. At least one of the plurality of branch pipes may be configured as a branch pipe for kitchen or a branch pipe for bathroom which is connected to the branch pipe for dryer.

The branch pipe for kitchen or the branch pipe for bathroom may have a backflow preventive damper to prevent backflow of the exhaust gas from the clothes dryer therein, and may further have a fire damper therein.

The branch pipe for dryer may have a constant air volume damper therein, and may have at least one of a lint filter to filter lint and a carbon monoxide filter to filter carbon monoxide therein.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention associated with an exhaust structure for a clothes dryer in an apartment building, examples of which are illustrated in the accompanying drawings. Wherever possible, the same reference numbers will be used throughout the drawings to refer to the same or like parts.

Figure 1:
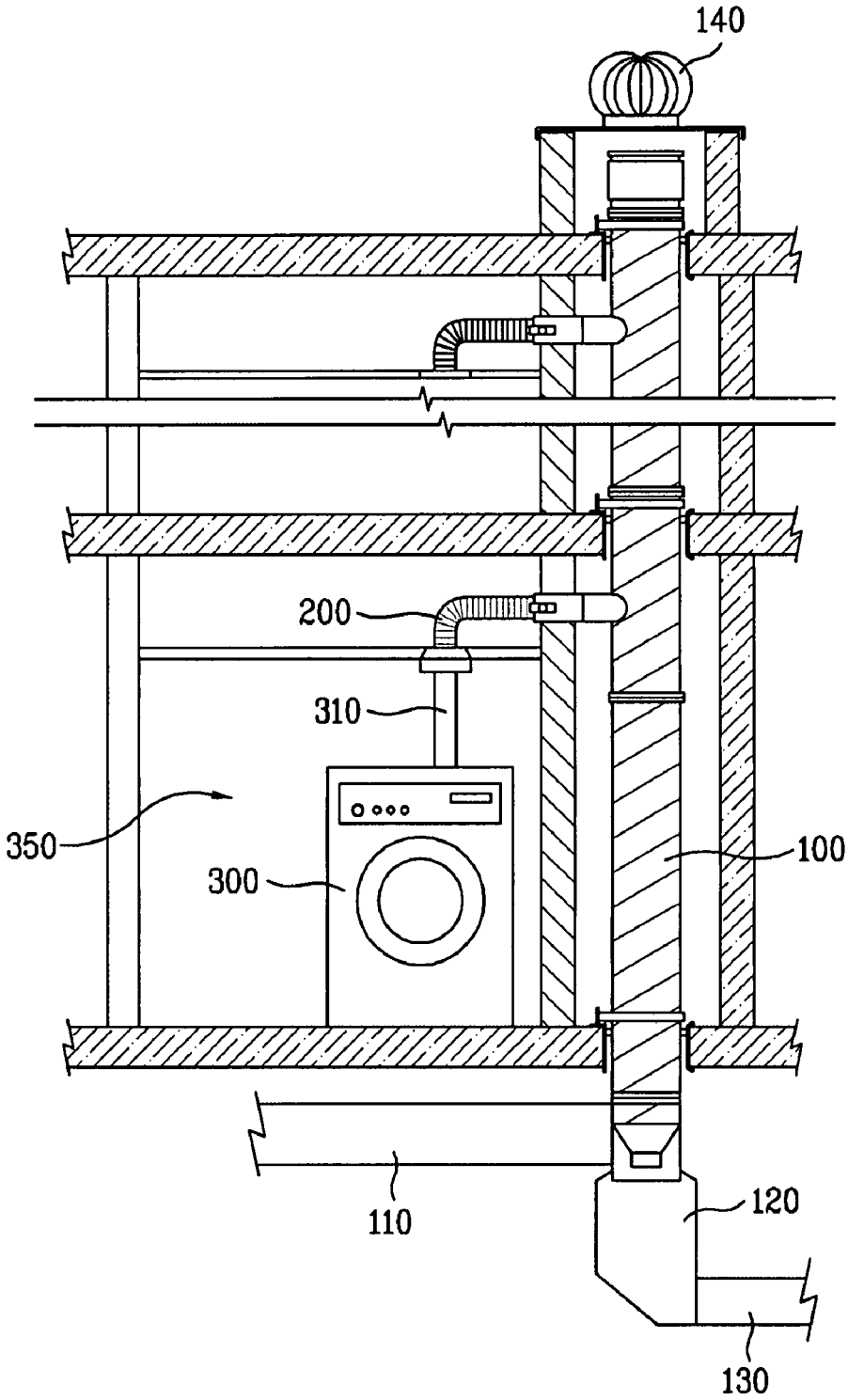
FIG. 1 is a partial sectional view illustrating an exhaust structure in accordance with a preferred embodiment of the present invention.

FIG. 1 is a sectional view illustrating an exhaust structure in an apartment building in accordance with a preferred embodiment of the present invention.

Referring to FIG. 1, an apartment building is equipped with a riser pipe 100 mounted in a vertical direction crossing every floor of the building, and a plurality of branch pipes 200 branched from the riser pipe 100 to respective households in the apartment building.

Here, the riser pipe 100 is used to exclusively discharge exhaust gas from a clothes dryer 300 to an outside of the building. In other words, the apartment building may be equipped with a plurality of riser pipes to discharge gas from bathrooms and kitchens. Of the plurality of riser pipes, the riser pipe 100 shown in FIG. 1 may be configured as a riser pipe to discharge gas from the clothes dryer 300.

The branch pipe 200 is branched from the riser pipe 100, and extends to a laundry room 350 equipped with the clothes dryer 300. A discharge hole of the clothes dryer 300 is connected to an inlet of the branch pipe 200 by a gas discharge pipe 310.

A fan 140 is mounted above a top of the riser pipe 100. It is preferred that the fan 140 is connected to a power unit, such as a motor (not shown). A non-power fan may be used to discharge gas from the clothes dryer 300 to the outside through the riser pipe 100. However, the capacity of the non-power fan may be insufficient to discharge a large amount of exhaust gas from the clothes dryer. Further, because the clothes dryer is operated for a comparatively long time and living patterns of the households are similar, a large amount of gas gathers into the riser pipe from the branch pipes of the respective households. Accordingly, it is preferred that the fan 140 is connected to a power unit.

Although not illustrated, a first pressure sensor (not shown) is mounted in the riser pipe 100, and transmits a sensing result to a motor controller (not shown) to control the motor. A mounting position of the motor controller is not certainly limited. The motor controller may be mounted adjacent to the motor or in the laundry room 350.

An outdoor air pipe 110 is connected to a lower portion of the riser pipe 100 so that the riser pipe 100 communicates with the outside. A drain structure 120 is mounted under the outdoor air pipe 110. The drain structure 120 is connected to a drain pipe 130 to drain condensed water included in the gas from the riser pipe 100.

Figure 2:
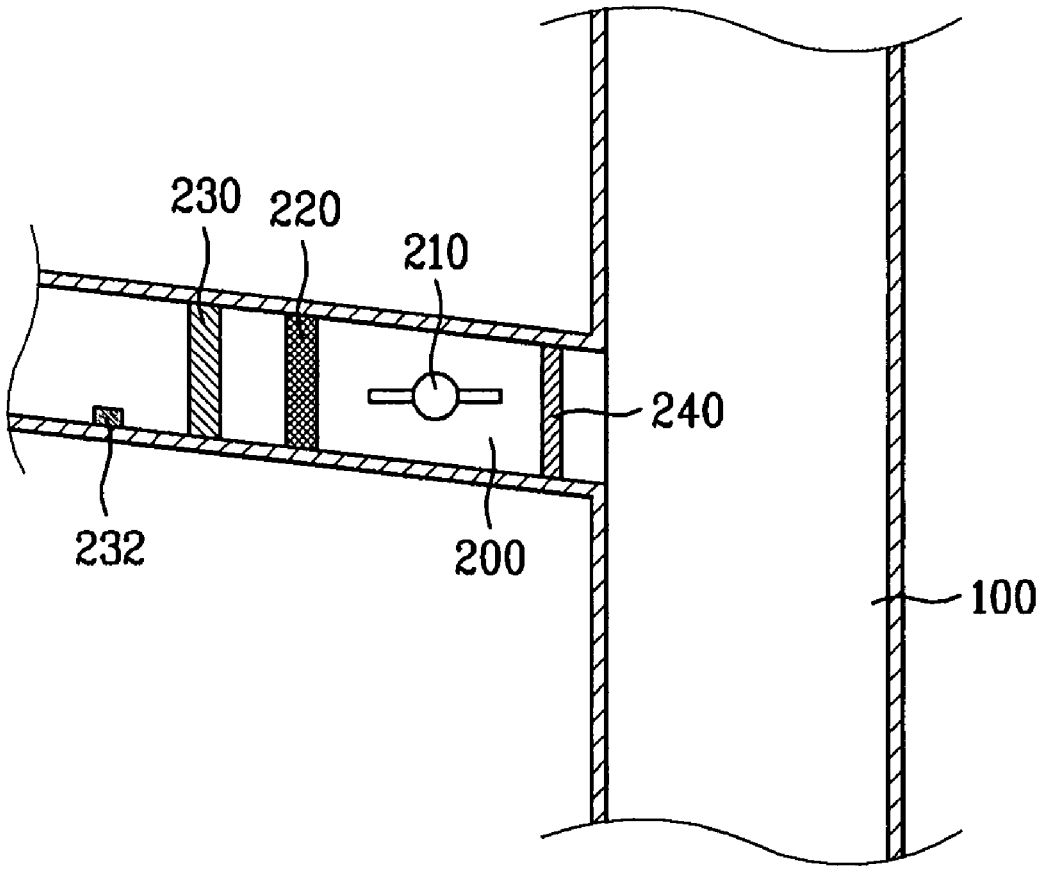
FIG. 2 is a sectional view illustrating a connecting structure of a branch pipe and a riser pipe shown in FIG. 1.

Referring to FIG. 2, inside the branch pipe 200 are mounted a backflow preventive damper 210 to prevent backflow of the gas, a carbon monoxide filter 220 to filter carbon monoxide from the gas, and a lint filter 230 to filter lint from the gas.

Depending on the kinds of heat source to generate hot air, clothes dryers can be classified into an electric type clothes dryer, and a clothes dryer configured to burn fuel, such as coal or fuel gas. When the apartment building is equipped with a clothes dryer configured to burn fuel, it is required to filter carbon monoxide from exhaust gas from the clothes dryer and discharge the exhaust gas to the riser pipe 100. Otherwise, a problem may occur such that the exhaust gas containing carbon monoxide is introduced into the household. Taking into account a residential environment of a high-rise building, in which ventilation by opening the window is difficult, a requirement for preventing the introduction of carbon monoxide into the household is larger.

Further, it is preferred that a fire damper 240 is mounted in the branch pipe 200. This is to prevent fire from spreading to other households through the riser pipe 100 and the branch pipe 200.

Inside the branch pipe 200 is mounted a second pressure sensor 232 in front of the lint filter 230. The second pressure sensor 232 may be configured to transmit a sensing signal to a filter controller (not shown) separately provided in the laundry room 350 or to a filter controller provided in the clothes dryer 300. For example, a signal line from the second pressure sensor 232 may be connected to the controller provided in the dryer 300. For such a constitution, a connector may be provided in the dryer 300 to receive a signal from the outside.

Hereinafter, a gas flow from the dryer 300 in the exhaust structure having the above constitution will be described.

The gas exhausted from the clothes dryer 300 is discharged into the riser pipe 100 via the gas discharge pipe 310 and the branch pipe 200. If the clothes dryer 300 is structured to produce hot air by burning fuel, the exhaust gas from the clothes dryer 300 may contain carbon monoxide. Carbon monoxide can be removed by the carbon monoxide filter 220 mounted in the branch pipe 200.

The lint included in the exhaust gas is removed by the lint filter 230 mounted in the branch pipe 200.

The exhaust gas introduced into the riser pipe 100 via the branch pipe 200 is discharged to the outside of the building through the top of the riser pipe 100.

The fan 140 mounted above the top of the riser pipe 100 is rotated by the motor. The operation of the fan 140 will now be described in more detail.

This inventor has discovered that the amount of exhaust gas from the clothes dryer 300 can be derived experimentally or theoretically by using a pressure in the riser pipe 100. In other words, it is possible to detect the amount of exhaust gas from the clothes dryer 300 by using the pressure sensed by the first pressure sensor mounted in the riser pipe 100. Moreover, correlation between a rotational speed of the fan 140 and the amount of gas to be discharged can be derived experimentally or theoretically. Based on the above correlation, the power unit can be controlled to control the rotational speed of the fan 140. The amount of exhaust gas can be measured by the pressure sensed by the first pressure sensor, and the rotational speed of the fan 140 is controlled according to the measured amount of exhaust gas.

In this case, it is preferred that the motor (not shown) composing the power unit is controlled to apply a driving force to the fan 140 in proportion to the amount of gas to be discharged.

Describing in detail, if the pressure in the riser pipe 100 is sensed by the first pressure sensor mounted in the riser pipe 100, the amount of exhaust gas in the riser pipe 100 is measured, and the driving force of the motor is determined according to the measured amount of exhaust gas. Accordingly, if the amount of exhaust gas from the clothes dryer 300 is large, the motor increases the rotational speed of the fan 140 to increase a discharge speed of the exhaust gas.

If the fan 140 is driven by the power unit as described above, a pressure distribution in the riser pipe 100 varies according to the amount of gas to be discharged and the rotational speed of the fan 140. Therefore, so as to discharge the gas most smoothly, it is preferable to control the rotational speed of the fan according to the amount of gas to be discharged in consideration of the pressure distribution.

This inventor has carried out computer simulation on the pressure distribution in the riser pipe 100 according to the rotational speed of the fan 140. The simulation has been carried out for cases such that the gas is discharged outside from the riser pipe 100 at speeds of 2 m/s, 12 m/s and 22 m/s.

The result of the simulation shows that when the pressure distribution in the riser pipe 100 and the pressure distribution in the exterior of the building are equal, the exhaust gas is smoothly discharged outside the building. When considering that a pressure drop in the exterior of the building according to increase in height is 4 Pa/3 m (here, 3 m is substantially equivalent to a height of one story of the building), the pressure distribution in the riser pipe 100 is most similar to the pressure distribution in the exterior of the building when the discharge speed of the gas is 12 m/s.

Accordingly, the motor can apply a driving force to the fan 140 so that the fan 140 can rotate at a rotational speed capable of making the pressure distribution in the riser pipe 100 similar to the pressure distribution in the exterior of the building according to the amount of exhaust gas in the riser pipe 100.

Because the exhaust gas from the clothes dryer 300 contains a large amount of moisture, the moisture is liable to be condensed to a liquid on an inner wall of the riser pipe 100. The condensed liquid flows down along the inner wall of the riser pipe 100, and is drained outside via the drain structure 120. Although not illustrated, the drain structure 120 may include a water collecting part, a drain pump, a valve and a float switch.

The operation of the pump may be controlled manually by a user, or automatically. When the operation of the pump is controlled automatically, the float switch is mounted in the water collecting part so as to be switched as a float floats to a predetermined height. The float switch may be configured in a mechanical type or an electrical type. For instance, when the float floats to a predetermined height, the float switch is switched to open the valve and operate the drain pump.

Because the outdoor air pipe 110 is connected to the lower portion of the riser pipe 100, the exhaust gas can be more smoothly discharged outside from the top of the riser pipe 100.

Even if the riser pipe 100 is filled with the exhaust gas and thus the inner pressure rises, the gas flowing backward to the branch pipe 200 is blocked by the backflow preventive damper 210 mounted in the branch pipe 200, failing to be introduced into the household.

Currently, since clothes dryer using time in each household is relatively long, the using time may be overlapped among the households. In such a case, the amount of exhaust gas discharged into the riser pipe 100 is increased, and a pressure in the riser pipe 100 rises, which may cause the exhaust gas in the riser pipe 100 to flow backward into each household through the branch pipe 200. The backflow preventive damper 210 serves to prevent the backflow of the exhaust gas into the household.

If the lint filter 230 in the branch pipe 200 is blocked with lint, the pressure sensed by the second pressure sensor 232 provided in front of the lint filter 230 rises. Accordingly, the filter controller provided in the laundry room 350 or the clothes dryer 300 compares the sensed pressure with a reference pressure, and emits an alarming sound or turns on a lamp to inform a user that the lint filter 230 is blocked and needs to be replaced.

It is preferred that the branch pipe 200 is connected to the riser pipe 100 with a predetermined downward inclination. This is for preventing liquid condensed from moisture included in the exhaust gas from flowing backward to the clothes dryer 300 via the branch pipe 200, and directing the liquid to the riser pipe 100.

When the clothes dryer 300 is installed in the laundry room 350 in each household, a user connects the discharge hole of the clothes dryer 300 to the branch pipe 200 by the gas discharge pipe 310. Therefore, it is preferred that the gas discharge pipe 310 is flexible so as to be bent softly.

The lint filter 230, the carbon monoxide filter 220 and the backflow preventive damper 210 may be mounted in the branch pipe 200 or in the gas discharge pipe 310 as needed by the design. For example, different from the aforesaid embodiment, at least one of the lint filter 230, the carbon monoxide filter 220 and the backflow preventive damper 210 may be mounted in the gas discharge pipe 310. When at least one of the lint filter 230, the carbon monoxide filter 220 and the backflow preventive damper 210 is mounted in the gas discharge pipe 310, the same element is not necessarily mounted in the branch pipe 200, but the mounting of the same element in the branch pipe 200 does not matter.

If a seller of the clothes dryer 300 provides the gas discharge pipe 310 together with the clothes dryer 300, the gas discharge pipe 310 may have the lint filter 230, the carbon monoxide filter 220 and the backflow preventive damper 210 therein. In this case, a building equipped with the branch pipe 200 having only the fire damper 240 therein may be provided by a constructor. However, it does not mean that the fire damper 240 should be mounted in the branch pipe 200 but not in the gas discharge pipe 310.

The gas discharge pipe 310 may not be required depending on a shape of the branch pipe 200. This is because the gas discharge pipe 310 may be provided by a constructor while being integrally connected to the branch pipe 200, or a structure of a conventional kitchen or bathroom may be utilized for the gas discharge pipe 310. For example, a fan may be mounted in the inlet of the branch pipe 200, and the clothes dryer 300 may be installed such that the discharge hole of the clothes dryer 300 is positioned close to the inlet of the branch pipe 200. In such a case, a structure similar to a hood device used in a conventional kitchen may be provided close to the inlet of the branch pipe 200.

Different from the above description, the second pressure sensor, for determining whether the lint filter 230 is blocked, may be provided in an exhaust gas discharge passage in the clothes dryer 300.

In case of the clothes dryer 300 configured to produce hot air by burning fuel, the carbon monoxide filter 220 may be mounted in the exhaust gas discharge passage in the clothes dryer 300.

The backflow preventive damper 210 may also be mounted in the exhaust gas discharge passage in the clothes dryer 300. When the discharge hole of the clothes dryer 300 is connected to the gas discharge pipe 310 and the gas discharge pipe 310 is connected to the branch pipe 200, the exhaust gas flowing backward from the riser pipe 100 is blocked by the backflow preventive damper 210 mounted in the clothes dryer 300, failing to be introduced into the household.

Figure 3:
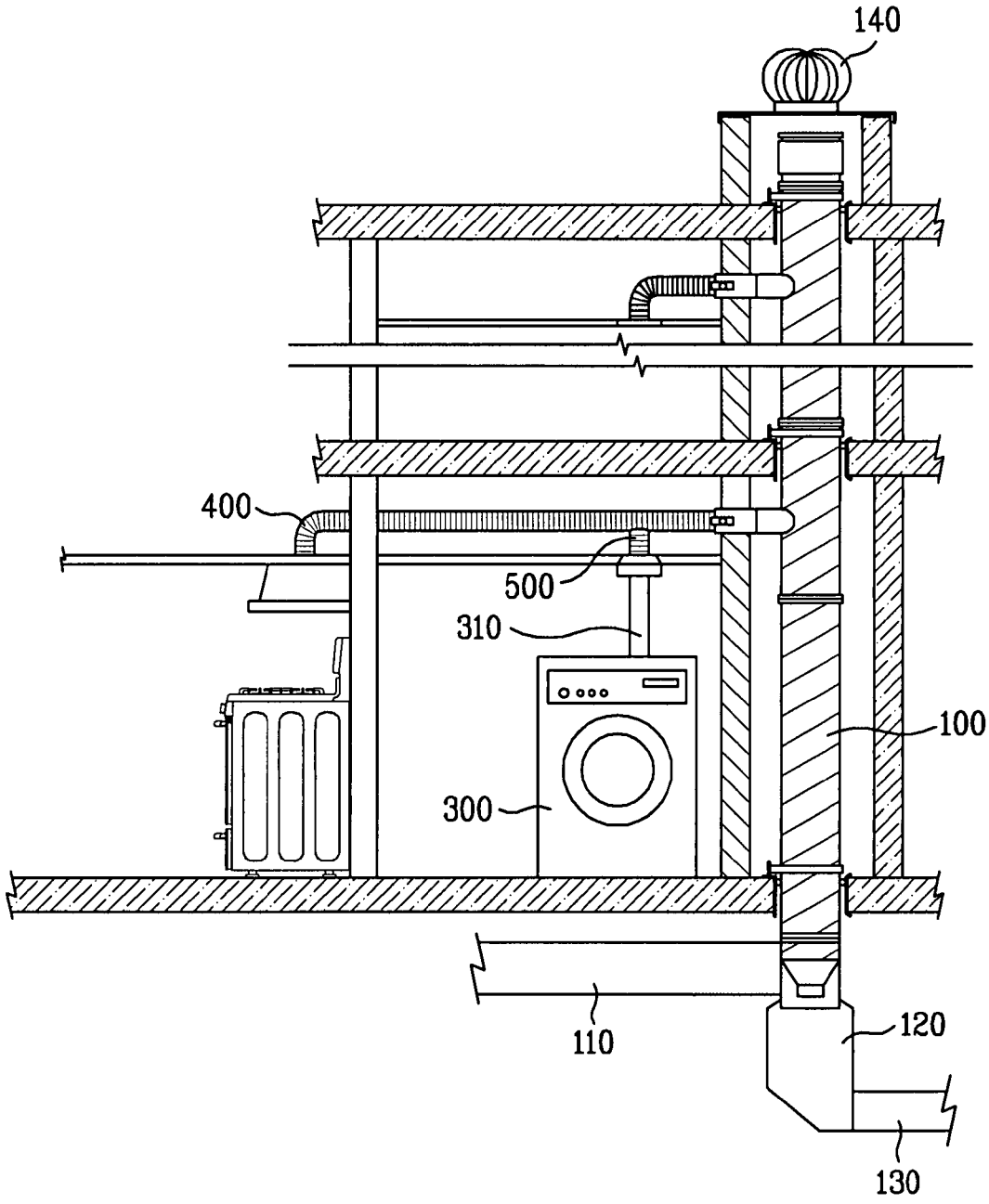
FIG. 3 is a partial sectional view illustrating an exhaust structure in accordance with another preferred embodiment of the present invention.

FIG. 3 is a partial sectional view illustrating an exhaust structure in accordance with another preferred embodiment of the present invention. An exhaust structure of this embodiment has features such that a branch pipe 500 for dryer for discharging the exhaust gas from the clothes dryer 300 is connected to another branch pipe 400, e.g., the branch pipe 400 for kitchen. However, the present invention is not restricted to the above structure. In other words, the branch pipe 500 for dryer can also be connected to a branch pipe for bathroom besides the branch pipe 400 for kitchen. Hereinafter, a difference of this embodiment from the previous embodiment will be described.

Referring to FIG. 3, the exhaust structure of this embodiment includes a plurality of branch pipes 400 and 500 branched from the riser pipe 100 and extending to the respective households. Some of the branch pipes are connected to each other. As shown in the drawing, the branch pipe 500 for dryer for guiding the exhaust gas from the clothes dryer 300 to the riser pipe 100 is connected to the branch pipe 400 for kitchen which extends from the kitchen.

Figure 4:
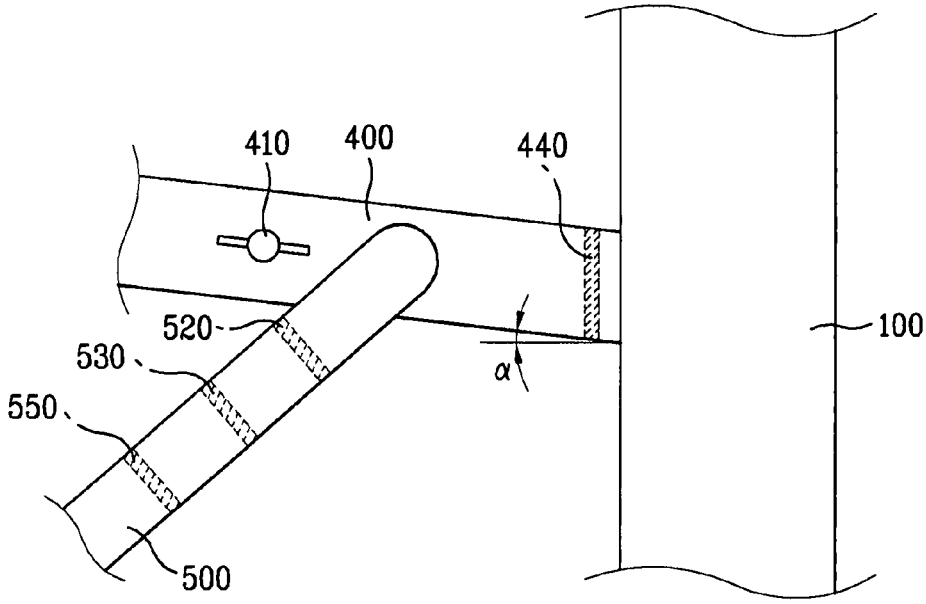
FIG. 4 is a schematic view illustrating a connecting structure of a branch pipe and a riser pipe shown in FIG. 3.

FIG. 4 is a schematic view illustrating a connecting structure of the branch pipe and the riser pipe shown in FIG. 3.

Referring to FIG. 4, a backflow preventive damper 410 and a fire damper 440 are mounted in the branch pipe 400 for kitchen, and a carbon monoxide filter 520, a lint filter 530 and a constant air volume damper 550 are mounted in the branch pipe 500 for dryer. Since the constitution of disposing a pressure sensor in front of the lint filter 530 is similar to the previous embodiment, detailed explanation thereof will be omitted.

If the riser pipe 100 is filled with the exhaust gas and thus a pressure in the riser pipe 100 rises, the exhaust gas may flow backward to the branch pipe 400 for kitchen and the branch pipe 500 for dryer. However, the backflow preventive damper 410 mounted in the branch pipe 400 for kitchen prevents the inflow of the exhaust gas from the riser pipe 100 into the kitchen, and the constant air volume damper 550 mounted in the branch pipe 500 for dryer prevents the inflow of the exhaust gas from the riser pipe 100 into the laundry room. Also, the backflow preventive damper 410 prevents the inflow of the exhaust gas from the clothes dryer 300 into the kitchen, and the constant air volume damper 550 prevents the inflow of the exhaust gas from the kitchen into the laundry room.

As shown in FIG. 4, the branch pipe 400 for kitchen is connected to the riser pipe 100 with a predetermined downward inclination (angle of a). This is for directing liquid condensed from moisture contained in the exhaust gas to the riser pipe 100.

The constant air volume damper 550 may be mounted in the exhaust gas discharge passage in the clothes dryer 300. When the discharge hole of the clothes dryer 300 is connected to the gas discharge pipe 310 and the gas discharge pipe 310 is connected to the branch pipe 500 for dryer, the exhaust gas flowing backward from the riser pipe 100 is blocked by the constant air volume damper 550 mounted in the clothes dryer 300, failing to be introduced into the household.

The exhaust structure according to the present invention as described above has the following advantages.

According to the present invention, there are provided an exhaust structure adequate to exclusively discharge exhaust gas from clothes dryers in an apartment building, especially a high-rise apartment building, to outside the building, and a clothes dryer manufactured suitable for such an exhaust structure.

Further, the exhaust structure according to the present invention can solve the discharge problems of exhaust gas from the clothes dryers that occur in the high-rise apartment building. Specifically, the exhaust structure according to the present invention can also solve the problems that cannot be solved by a conventional exhaust structure for a kitchen or bathroom due to characteristics of the exhaust gas from the clothes dryer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An exhaust structure for a clothes dryer in an apartment building, comprising:

at least one riser pipe mounted in a vertical direction crossing every floor of a building to discharge exhaust gas;

a plurality of branch pipes branched from the riser pipe to a household in the every floor to guide exhaust gas from the household to the riser pipe;

a fan mounted above a top of the riser pipe, the fan operating in proportion to the amount of exhaust gas in the riser pipe, wherein at least one of the plurality of branch pipes is configured as a branch pipe for a dryer to guide the exhaust gas from the clothes dryer provided in the household to the riser pipe;

a first pressure sensor to sense a pressure in the riser pipe; and a second pressure sensor to sense a pressure in each of the plurality of branch pipes.

2. The exhaust structure according to claim 1, further comprising:

a motor to apply a driving force to the fan;

and a motor controller to control operation of the motor according to a pressure sensed by the first pressure sensor.

3. The exhaust structure according to claim 2, wherein the motor controller controls operation of the motor according to the amount of exhaust gas in the riser pipe measured based on the pressure sensed by the first pressure sensor.

4. The exhaust structure according to claim 1, wherein each of the plurality of branch pipes has at least one of a backflow preventive damper to prevent backflow of the exhaust gas and a fire damper therein.

5. The exhaust structure according to claim 1, wherein each of the plurality of branch pipes has at least one of a lint filter to filter lint and a carbon monoxide filter to filter carbon monoxide therein.

6. The exhaust structure according to claim 5, wherein the second pressure sensor provided in front of the lint filter to sense a pressure in each of the plurality of branch pipes.

7. The exhaust structure according to claim 6, further comprising:

a filter controller to determine whether the lint filter is blocked based on the pressure sensed by the second pressure sensor.

8. The exhaust structure according to claim 7, wherein the filter controller determines whether the lint filter is blocked by comparing the sensed pressure with a reference pressure.

9. The exhaust structure according to claim 8, wherein when the lint filter is blocked, the filter controller informs a user visually and acoustically that the lint filter is blocked.

10. The exhaust structure according to claim 1, further comprising:

a drain structure provided under the riser pipe to drain water condensed from the exhaust gas.

11. The exhaust structure according to claim 10, further comprising:

an outdoor air pipe connected to a lower portion of the riser pipe, the outdoor air pipe communicating with an exterior.

12. The exhaust structure according to claim 1, wherein the plurality of branch pipes are connected to the riser pipe with a predetermined downward inclination.

13. The exhaust structure according to claim 1, wherein at least one of the plurality of branch pipes is configured as a branch pipe for kitchen or a branch pipe for bathroom which is connected to the branch pipe for dryer.

14. The exhaust structure according to claim 13, wherein the branch pipe for kitchen or the branch pipe for bathroom has a backflow preventive damper to prevent backflow of the exhaust gas from the clothes dryer therein.

15. The exhaust structure according to claim 14, wherein the branch pipe for kitchen or the branch pipe for bathroom further has a fire damper therein.

16. The exhaust structure according to claim 13, wherein the branch pipe for dryer has a constant air volume damper therein.

17. The exhaust structure according to claim 16, wherein the branch pipe for dryer has at least one of a lint filter to filter lint and a carbon monoxide filter to filter carbon monoxide therein.

* * * * *